US006454230B1

(12) United States Patent
Accuardi

(10) Patent No.: US 6,454,230 B1
(45) Date of Patent: Sep. 24, 2002

(54) TOOL HOLDER FOR USE WITH A PERFORATED SUPPORT PANEL

(75) Inventor: Ron Accuardi, Stow, OH (US)

(73) Assignee: Triton Products, Twinsburg, OH (US)

( * ) Notice: Subject to any disclaimer, the term of this patent is extended or adjusted under 35 U.S.C. 154(b) by 0 days.

(21) Appl. No.: 09/793,859

(22) Filed: Feb. 26, 2001

(51) Int. Cl.[7] ..... A47B 96/06; A47G 29/00; A47G 1/00; E04G 3/00; E04G 5/06

(52) U.S. Cl. ..... 248/220.31; 248/220.41; 248/220.43; 248/224.8

(58) Field of Search ..... 248/220.22, 220.31, 248/220.41, 220.42, 220.43, 224.8

(56) References Cited

U.S. PATENT DOCUMENTS

| | | | | | |
|---|---|---|---|---|---|
| 3,879,006 | A | * | 4/1975 | Staudte, Jr. | 248/223 |
| 3,908,948 | A | * | 9/1975 | Hawthorne | 248/223 |
| 3,964,712 | A | * | 6/1976 | Staudte, Jr. | 248/223 |
| 4,441,619 | A | | 4/1984 | Gibitz | 211/60 |
| 4,750,700 | A | | 6/1988 | Wade | 248/221.2 |
| 4,762,299 | A | | 8/1988 | Langelier | 248/220.4 |
| 4,785,511 | A | | 11/1988 | Nagel | 79/7 |
| D300,301 | S | | 3/1989 | Furst et al. | D8/363 |
| 4,863,131 | A | | 9/1989 | Kinseley | 248/220.4 |
| 4,976,058 | A | | 12/1990 | Valiulis | 40/657 |
| 5,009,381 | A | | 4/1991 | Hermanson | 248/221.1 |
| 5,026,011 | A | | 6/1991 | Hoefkes | 248/220.4 |
| 5,027,622 | A | | 7/1991 | Hatch et al. | 70/14 |
| 5,165,640 | A | * | 11/1992 | Williams, III | 248/221.2 |
| 5,407,160 | A | | 4/1995 | Hollingsworth et al. | 248/221.2 |
| D376,086 | S | | 12/1996 | Hollingsworth | D8/71 |
| D377,594 | S | | 1/1997 | Hollingsworth | D8/71 |
| 5,673,887 | A | | 10/1997 | Hollingsworth et al. | 248/220.31 |
| 6,003,685 | A | * | 12/1999 | Malin | 211/7 |

OTHER PUBLICATIONS

"Hard to Find Tools" on the web at *www.brookstone.com,* p. 9, at least one year earlier than date of invention.

Talon, "Lock–On Peg Hooks" (2 pages), at least one year earlier than date of invention.

Windsor Industries, Inc., "Loc–Hooks" Catalog No. 311–B, pp. 1–4, at least one year earlier than date of invention.

Windsor Industries, Inc., "Complete Tool and Parts Managements Systems" catalog, pp. 4–8, 22–28, 31–32, Dated: 1998.

Windsor Industries, Inc., "Loc–Board's 5–Point Equipment Storage and Organization System" brochure, Dated: 1989.

* cited by examiner

*Primary Examiner*—Ramon O. Ramirez
*Assistant Examiner*—Amy J. Sterling
(74) *Attorney, Agent, or Firm*—Renner, Otto, Boisselle & Sklar, LLP

(57) ABSTRACT

A tool holder for use with a perforated support panel are disclosed. The tool holder includes a base plate at one end thereof and a panel engaging tab at an opposite end thereof. The base plate includes an aperture for receiving therethrough a fastener for insertion into a first perforation of the support panel to attach the tool holder to the support panel. The panel engaging tab is sized and dimensioned for insertion into a second perforation of the support panel and includes a step portion connected to and extending rearwardly from the base plate a distance less than the thickness of the support panel such that, when the tool holder is attached to the support panel by the fastener, a front surface of the tab engages a rear surface of the support panel at a portion of the perimeter of the second perforation, whereby the tab flexes relative to the base plate.

21 Claims, 2 Drawing Sheets

TOOL HOLDER FOR USE WITH A PERFORATED SUPPORT PANEL

FIELD OF THE INVENTION

This invention relates to a tool holder for use with a perforated support panel and, more particularly, to a tool holder providing improved strength characteristics and greater versatility.

BACKGROUND

Tool holders are used to hold objects, such as hand tools, garden tools, instruments, wires, cables, display items and picture hangers, to a perforated support panel. In the past, such support panels were referred to as pegboards or perf-boards. One known tool holder includes a base plate having a central engagement portion which receives, in projecting fashion, a hook, spring clip, tray, or other type of tool support or engagement member. At laterally opposite ends of the central portion are an aperture and a tab. A locking screw is passed through the aperture and threaded into a perforation of the perforated support panel to prevent removal of the tool holder from the support panel. The tab projects rearwardly of the central portion and is spaced from the aperture the same distance as the distance between adjacent perforations in the support panel. The tab is inserted into a perforation adjacent the perforation in which the locking screw is inserted. The tab prevents the base plate from rotating about the locking screw. A drawback to the aforedescribed and other tool holders is that the base plate can easily become loosened between the support panel and the locking screw when subjected to heavy loads and/or strain.

One known tool holder made of plastic includes a fastener button which has a pair of fingers stemming from a collar. The fastener button is inserted into a perforation in a support panel so that the pair of fingers are exposed on the other side of the support panel and the collar seats within the perforation. A screw is inserted into an opening in the fastener button to spread the fingers apart and into engagement with the rear surface of the support panel. A drawback to this type of tool holder is that, because the fingers are made of plastic, they are more susceptible to fatigue when flexed and/or subjected to heat stresses. It has been found that over prolonged periods of time the plastic fingers tend to lose their memory, making the screw difficult to remove from the fastener button and, consequently, making it difficult to remove the tool holder from the support panel. Also, repeated insertion/removal of the screw into/from the opening tends to wear the inside of the opening and, if the screw is also made of plastic, the screw as well.

SUMMARY OF THE INVENTION

Briefly, an aspect of the invention relates to improvements in tool holders which overcome one or more of the aforesaid drawbacks encountered with prior tool holders.

According to an aspect of the invention, a tool holder includes features enabling improved attachment to a perforated support panel. The support panel has at least first and second spaced perforations passing therethrough. The tool holder includes a base plate at one end thereof and a panel engaging tab at an opposite end thereof, wherein the base plate includes an aperture for receiving therethrough a fastener for insertion into the first perforation to attach the tool holder to the support panel, and wherein the panel engaging tab is sized and dimensioned for insertion into the second perforation and includes a step portion connected to and extending rearwardly from the base plate a distance less than the thickness of the support panel such that, when the tool holder is attached to the support panel by the fastener, a front surface of the tab engages a rear surface of the support panel at a portion of the perimeter of the second perforation, whereby the tab flexes relative to the base plate.

In an embodiment of the invention, the base plate includes an engagement portion located between the aperture and the panel engaging tab for securing thereto a tool supporting implement. The panel engaging member may extend from the base plate such that, when the tool holder is attached to the support panel by the fastener, a tool supporting implement secured to the engagement portion engages the front surface of the support panel. Also, the engagement portion may be offset forwardly from a front surface of the base plate.

In an embodiment of the invention, the step portion is spaced from the center of the aperture approximately the same distance as the distance between the first and second perforations.

In an embodiment of the invention, the panel engaging tab extends from the base plate such that, when the tool holder is attached to the support panel by the fastener, a rear surface of the base plate engages a region of the front surface of the support panel. In an embodiment, the region at which the rear surface of the base plate engages the front surface of the support panel is at a portion of the perimeter of the second perforation diametrically opposite that at which the front surface of the tab engages the rear surface of the support panel. In yet another embodiment, the panel engaging tab includes a biasing member that is sloped outwardly relative to a plane in which the rear surface of the base plate lies.

According to another aspect of the invention, a tool holder is adapted for installation into a first support panel or a second support panel, the support panels having different thicknesses and respective first and second perforations. The tool holder includes a base plate at one end thereof, a biasing member at an opposite end thereof, and an intermediate step portion therebetween, wherein the biasing member is sized and dimensioned for insertion into either of the first or second perforations and the step portion is less in length than the thickness of either the first or second support panels such that, when the biasing member is inserted into either of the first or second perforations and urged towards a rear surface of the respective first or second support panel and the base plate is urged towards a front surface of thereof and attached thereto, the biasing member flexes relative to the base plate and secures the tool holder the respective support panel.

In an embodiment of the invention, a front surface of the biasing member engages the rear surface of the respective first or second support panel at a portion of the perimeter of the respective first or second perforation. In addition, or alternatively, a rear surface of the base plate engages a front surface of the respective first or second support panel at a portion of the perimeter of the respective first or second perforation at a region diametrically opposite that of the portion of the perimeter at which the front surface of the biasing member engages the rear surface of the respective first or second support panel.

In an embodiment of the invention, the tool holder includes an aperture for receiving either a first fastener suitable for attaching the tool holder to the first support panel or a second fastener having a different diameter than that of the first fastener and suitable for attaching the tool holder to the second support panel. In still another embodiment, the biasing member and base plate extend in opposite directions from the base plate. Also, in an embodiment, the biasing member is generally in a plane that is at a non-parallel angle relative to a plane in which the base plate is in. The angle may be any angle which would cause the biasing member to flex as the base plate is attached to the support panel to improve the secured attachment of the tool holder to the support panel.

The foregoing and other features of the invention are hereinafter more fully described and particularly pointed out in the claims, the following description and the annexed drawings setting forth in detail an illustrative embodiment of the invention, such being indicative, however, of but one of the various ways in which the principles of the invention may be employed.

DETAILED DESCRIPTION

Figure 1:
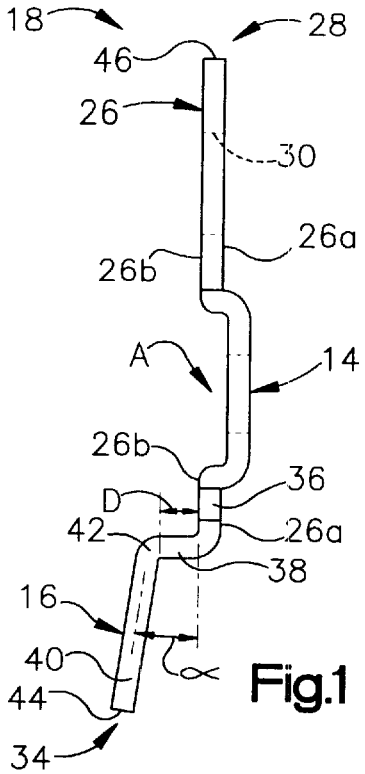
FIG. 1 is a side elevational view of a tool holder according to the present invention.
Figure 2:
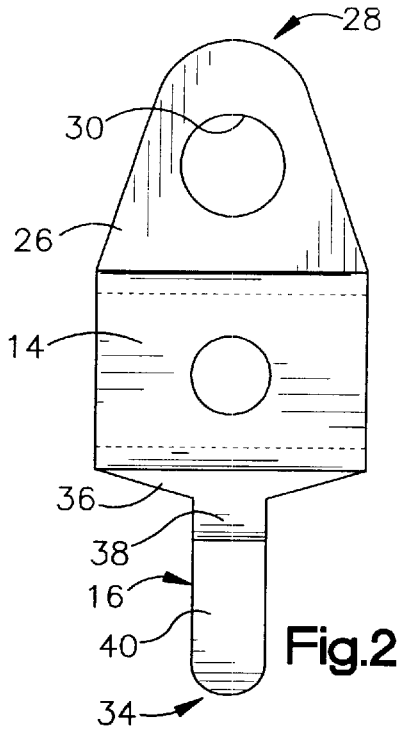
FIG. 2 is a front elevational view of the tool holder of FIG. 1.

Referring now to the drawings in general, FIGS. 1 and 2 show a tool holder 10 in accordance with the present invention. The tool holder 10 is fastened to a perforate support panel 12 (FIGS. 3 and 4) having a plurality of uniformly spaced perforations 13. The perforate support panel 12 may be a pegboard, a perfboard, a tempered hardboard, or a plastic pegboard. The perforations 13 are typically on one inch centers (i.e., the perforations are spaced apart one inch) or on ½ inch centers. The tool holder 10 holds or supports a tool, or other implement, to the support panel 12 by means of, for example, a hook, spring clip, tray, or other type of tool support or engagement member (not shown) which is welded, riveted or otherwise secured to a central engagement portion 14 of the tool holder 10.

The tool holder 10 includes a panel engaging tab 16 which improves the rigidity and security of the connection of the tool holder 10 to the support panel 12. The panel engaging tab 16 also enables the tool holder 10 to be installed in different thickness support panels; for example, the illustrated tool holder 10 may be installed in the support panel 18 shown in FIGS. 5 and 6, which has a thickness less than that of the support panel 12 shown in FIGS. 3 and 4. The tool holder 10 is fastened to the support panel 12 by a suitable fastener.

The tool holder 10 includes a base plate 26 at one end 28 of the tool holder 10 and a panel engaging tab 16 at an opposite or second end 34 of the tool holder 10. The base plate 26 has a front surface 26*a* and a rear surface 26*b*. An aperture 30 extends through the thickness of the base plate 26 and is sized to receive therethrough a locking screw 32.

A central engagement portion 14 is disposed between the first end 28 and second end 34 of the tool holder 10. In the illustrated embodiment, the engagement portion 14 is offset from the front surface 26*a* of the base plate 26. The offset provides clearance A for a rivet, screw or weld for securing a hook or other engagement member to the central engagement portion 14, such that when the tool holder 10 is installed into the support panel 12 (shown in phantom lines in FIGS. 3 and 4), with the rear surface 26*b* of the base plate 26 adjacent to and flush with the front surface 12*a* of the panel 12, the rivet or weld does not contact the front surface 12*a* of the support panel 12. As is further described below, in some applications it may be desirable to have the rivet or weld contact the front surface 12*a* of the support panel 12.

The panel engaging tab 16 is connected to a tapered portion 36 of the base plate 26 and has a substantially rectangular and uniform shape cross section throughout its length. The panel engaging tab 16 includes a step portion 38 which extends rearwardly from the rear surface 26*b* of the base plate 26. In an embodiment, the step portion 38 extends perpendicularly from the rear surface 26*b* of the base plate 38, although it will be appreciated that the step portion 38 may extend from the rear surface 26*b* of the base plate 38 at a different angle. As is most clearly shown in FIG. 3, the depth D at which the step portion 38 extends from the rear surface 26*b* of the base plate 26 is less than the thickness, X, of the support panel 12.

Figure 3:
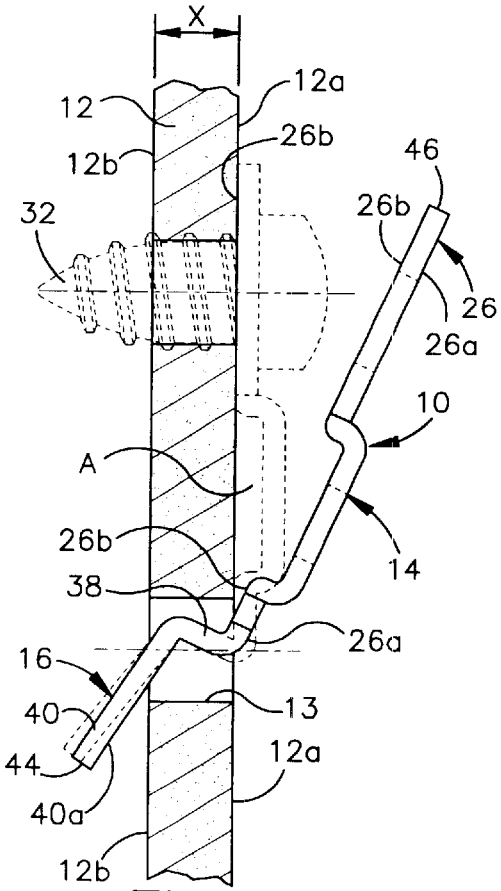
FIG. 3 is a side elevational view of the tool holder of FIG. 1 shown in place on a support panel, the solid lines illustrating the tool holder in an unflexed configuration and the phantom lines illustrating the tool holder in a flexed configuration.
Figure 4:
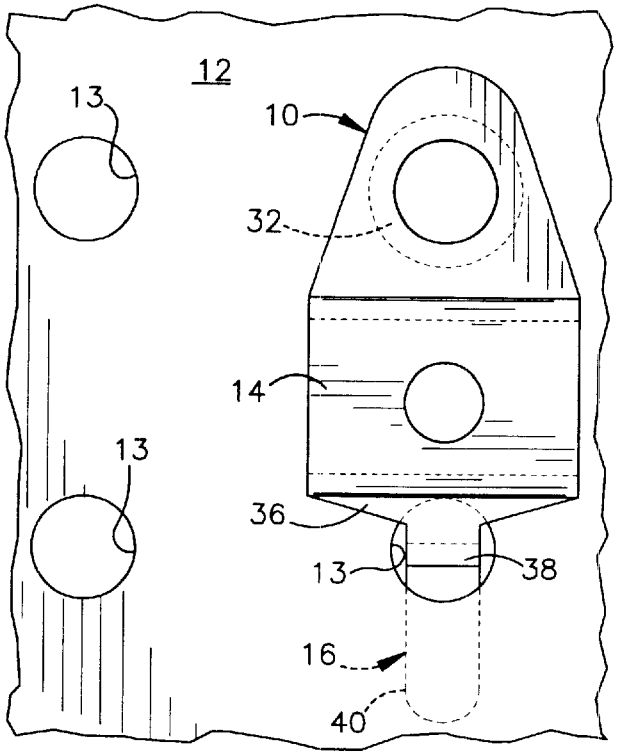
FIG. 4 is a front elevational view of the tool holder and panel of FIG. 3.

The step portion 38 is spaced from the center of the aperture 30 by approximately the same distance as the distance between adjacent perforations 13 in the support panel 12 (FIGS. 3 and 4). In some cases, the tool holder 10 may be designed to fit multiple types of perforation spacings. For example, if the step portion 38 is spaced from the center of the aperture 30 by one inch, then the tool holder 10 may be installed on a support panel with perforations on one inch centers, or a support panel with perforations on ½ inch centers, wherein for the latter case the tool holder 10 straddles a perforation.

A biasing member 40 extends from the step portion 38. In the illustrated embodiment, the biasing member 40 extends downwardly from the distal end 42 of the step portion 38 of the tool holder 10. As is further described below, because the depth D at which the step portion 38 extends from the rear surface 26*b* of the base plate 26 is less than the thickness X of the support panel 12, when the tool holder 10 is installed in the support panel 12 the biasing member 40 engages the rear surface 12*b* of the support panel 12 at the perimeter of the perforation 13, which causes a distal end 44 of the biasing member 40 to flex away from the support panel 12.

As is shown in FIG. 1, the biasing member 40 in the illustrated embodiment is shown sloped at an angle alpha ($\alpha$) of about seven degrees relative to the plane in which the rear surface 26*b* of the base plate 26 lies. The sloping of the biasing member 40 relative to the base plate 26 facilitates the tool holder 10 accommodating different thickness panels by providing spacing between the biasing member 40 and base plate 26 that may be varied (as by flexing the biasing member 40) as the tool holder 10 is fastened to a support panel. It will be appreciated that other angles α may be suitable for facilitating accommodation of different thickness panels.

The length of the biasing member 40 enables the distal end 44 of the biasing member 40 to extend through the perforation 13 and behind the rear surface 12*b* of the support panel 12. To this end, the length of the biasing member 40 in the as-shown embodiment, is greater than about ⅔ the diameter of the perforation 13 in the support panel 12. It will be appreciated that the length of the biasing member 40 may be other than ⅔ the diameter of the perforation based on, for example, a smaller thickness support panel 12. As is shown in FIG. 4, the width of the tab 16 is less than the diameter of the perforation 13 to facilitate insertion of the tab 16 into the perforation 13. It will be appreciated that the width of the tab 16 may be larger than the diameter of the perforation 13 so as to create an interference fit between the tab 16 and perforation 13.

Referring to FIG. 3, the tool holder 10 is shown inserted into the support panel 12 in solid lines and fastened to the support panel 12 in phantom lines. The solid lines illustrate the tool holder 10 in an unflexed configuration and the phantom lines illustrate the tool holder 10 in a flexed configuration.

To install the tool holder 10 into the support panel 12, the biasing member 40 of the panel engaging tab 16 is inserted lengthwise into a perforation 13 (i.e., perpendicular to the support panel 12) until the distal end 44 of the biasing member 40 extends behind the rear surface 12*b* of the support panel 12 and the step portion 38 resides inside the perforation 13. The tool holder 10 is then tilted so that the base plate 26 is moved towards the front surface 12*a* of the support panel 12 and the biasing member 40 is moved towards the rear surface 12*b* of the support panel 12. As is shown in solid lines in FIG. 3, the tool holder 10 may be tilted until the front surface 40*a* of the biasing member 40 contacts the rear surface 12*b* of the support panel 12 at a portion of the perimeter of the perforation 13, and the rear surface 26*b* of the base plate 26 contacts a region of the front surface 12*a* of the support panel 12. In the illustrated embodiment, the rear surface 26*b* of the base plate 26 contacts the front surface 12*a* of the support panel 12 at a portion of the perimeter of the perforation 13 that is diametrically opposite that of the portion at which the front surface 40*a* of the biasing member 40 contacts the rear surface 12*b* of the support panel 12.

It is noted that, because the step portion 38 of the tab 16 is shorter than the depth of the perforation 13 (i.e., the thickness X of the support panel 12), only a portion of the biasing member 40 extends through the perforation 13 beyond the rear surface 12*b* of the support panel 12. A distal end 46 of the base plate 26 remains spaced from the front surface 12*a* of the support panel 12 when the base plate 26 is in its unflexed configuration (solid lines in FIG. 3).

The base plate 26 of the tool holder 10 is then forced towards the front surface 12*a* of the support panel 12 by urging the base plate 26 against the resistance provided by the panel engaging tab 16 at the perimeter of the perforation 13 at the rear surface 12*b* of the support panel 12, and the resistance provided by the base plate 26 at the front surface 12*a* of the support panel 12. In so doing, the biasing member 40 of the tab 16 bends, or flexes, outwardly and the distal end 44 is urged away from the support panel 12. It is noted that the biasing member 40 may slide at the perimeter of the perforation 13 when the base plate 26 is forced towards the front surface 12*a* of the support panel 12.

The locking screw 32 is then inserted into the aperture 30 and threaded into the perforation 13. The threads of the locking screw 32 engage the edge of the perforation 13 to draw the base plate 26 into adjacent relation with the support panel 12 and, in combination with the engagement of the tab 16 on the opposite side of the support panel 12, to securely anchor the tool holder 10 thereon. As is seen in FIG. 3, the tool holder 10 flexes (from the configuration shown in solid lines to the configuration shown in phantom lines) in response to being urged into adjacent relation with the front surface 12*a* of the support panel 12. Because the tool holder 10 is able to flex, the tool holder 10 may be installed into a support panel 12 having a thickness X (FIG. 3) or, as described below, a support panel 18 having a thickness Y (FIG. 5), or a support panel having a thickness between that of the support panels 12 and 18.

It will be appreciated that, due to the resiliency of the tool holder 10, the load required to flex the tool holder 10 and maintain the tool holder 10 secured to the support panel 12 translates into a biasing force against the locking screw 32; that is, a preload is exerted on the locking screw 32 by the tool holder 10. This biasing force, or preload, improves the locking effect of the locking screw 32 as well as the resistance of the connection between the tool holder 10 and the support panel 12 to vibrations and repeated loading/unloading of tools or the like to/from the tool holder 10. Accordingly, the overall strength and rigidity of the connection of the tool holder 10 to the support panel 12 is improved. Moreover, it has been found that this preload increases the load that the tool holder 10 can support.

The tool holder 10 may be made of steel, plastic, or any other material providing suitable resilient characteristics. Steel provides the tool holder 10 with better ability to flex and impart the bias on the locking screw than, for example, plastic. Also, plastic may fatigue or establish a new memory when, for example, it is repeatedly flexed or it is subjected to heat; in this regard, the plastic may lose its ability to bias the locking screw. Making the tool holder 10 from steel also provides the advantage that a hook or other implement may be welded or riveted to the tool holder 10.

It is noted that the region at which the front surface 12*a* of the support panel 12 is contacted, although in the illustrated embodiment is at the perimeter of the perforation 13, may be at a region elsewhere on the front surface 12*a* of the support panel 12. Also, the source of contact may be other than the base plate 26. In this regard, for example, the present invention also contemplates a rivet, screw or weld projecting rearwardly of the central engagement portion 14 contacting the front surface 12*a* of the support panel 12 when the base plate 26 is tilted towards the front surface 12*a* of the support panel 12.

Figure 5:
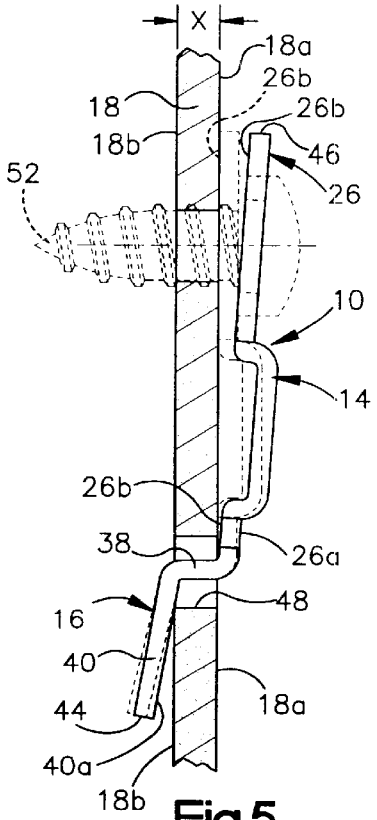
FIG. 5 is a side elevational view of the tool holder of FIG. 1 shown in place on a support panel, the support panel having a thickness different from that of the support panel shown in FIG. 3, the solid lines illustrating the tool holder in an unflexed configuration and the phantom lines illustrating the tool holder in a flexed configuration.
Figure 6:
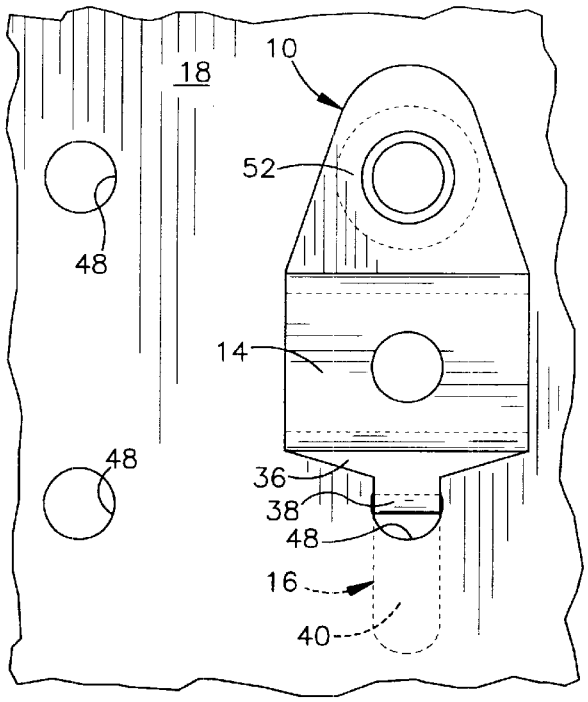
FIG. 6 is a front elevational view of the tool holder and panel of FIG. 5.

Referring now to FIGS. 5 and 6, the tool holder 10 is shown installed in a different support panel 18. In the drawings, like reference numerals correspond to like components, functions and features. The support panel 18 has a thickness less than that of the support panel 12 and has perforations 48 which are smaller in diameter than the perforations 13 of the support panel 12. The locking screw 52 is likewise smaller in diameter than that of the locking screw 32. It is noted that, as can be seen in FIG. 5, the depth D at which the step portion 38 extends from the rear surface 26*b* of the base plate 26 is less than the thickness of the support panel 18. Also, as is shown in FIG. 6, the width of the tab 16 is less than the diameter of the perforation 48 to facilitate insertion of the tab 16 into the perforation 48.

The tool holder 10 is installed into the support panel 18 in a manner similar to that described above with respect to the installation of the tool holder 10 into the greater thickness support panel 12 described above. FIG. 5 shows the tool holder 10 in an unflexed configuration in solid lines, and in a flexed configuration and fastened to the support panel 18 in phantom lines.

As is the case with the fastening of the tool holder 10 to the greater thickness support panel 12, when the base plate 26 is tilted towards the front surface 18*a* of the support panel 18, the front surface 40*a* of the biasing member 40 contacts the rear surface 18*b* of the support panel 18 at a portion of the perimeter of the perforation 48, and the rear surface 26*b* of the base plate 26 contacts the front surface 18*a* of the support panel 18 at the diametrically opposite portion of the perimeter of the perforation 48. The base plate 26 is then forced towards and brought into adjacent relation with the front surface 18*a* of the support panel 18, and secured thereto by the locking screw 52. As a consequence, the tool holder 10 exerts a preload on the locking screw 52 which, as is the case with the tool holder 10 and the greater thickness support panel 12, improves the locking effect of the locking screw 52 and the strength and rigidity of the connection of the tool holder 10 to the support panel 18.

It will be appreciated, then, that the tool holder 10 according to the present invention may be installed into different thickness support panels and provide improved strength characteristics. The range of thicknesses of support panels into which the tool holder 10 may be installed will generally depend on the size and geometry of the panel engaging tab 16, the spacing between the tab 16 and the rear surface 26*b* of the base plate 26, and the size and dimensions of the screw that the aperture 30 of the tool holder 10 can accommodate. To this end, the length of the biasing member 40, as well as the angle aplha ($\alpha$) at which it is disposed relative to the plane in which the base plate 26 lies, is sufficient to engage the rear surface of the support panel at the perimeter of the perforation. Also, the length of the biasing member 40 is generally sufficient to extend from the distal end 42 of the step portion 38 to the perimeter of the perforation when the tool holder 10 is in a tilted unflexed configuration, as shown in phantom lines in FIGS. 3 and 5. In the illustrated embodiments the length of the biasing member is about ⅔ the diameter of the perforation in the support panel. Also, as was noted above, the width of the panel engaging tab 16 is less than the diameter of the perforations in the respective support panels (for example, the support panels 12 and 18) into which the tool holder 10 is intended to be inserted.

The depth D at which the step portion 38 extends from the rear surface 26*b* of the base plate 26 is less than the thickness of the support panels into which the tool holder 10 is intended to be inserted. For example, in the illustrated embodiments, the depth D is less than the thickness X or Y of either of the respective support panels 12 or 18. As was noted above, it is for this reason that the tool holder 10 effects a preload on the locking screw. Of course, the tool holder 10 may be installed into a support panel having a thickness less than the depth D at which the step portion 38 extends from the rear surface 26*b* of the base plate 26, in which case the biasing member 40 may not engage or otherwise contact the perimeter of the perforation.

The diameter of the aperture 30 is sized to receive fasteners of a range of diameters. In the perfboard industry, different thickness support panels may have different size perforations. According to the invention, the aperture 30 of the tool holder 10 is sized to accommodate a fastener in an upper range, for example, for a support panel having a predetermined perforation size, and a fastener in a lower range, for example, for a support panel having a relatively smaller perforation size. In either case, the surface area provided by the base plate 26 at the perimeter of the aperture 30 is larger than the respective bearing surfaces of the heads of the fasteners which would be installed into such support panels.

A tool holder 10 has been constructed in accordance with the invention as hereafter described. The depth D of the step portion 38 is about 0.112 inch, the length of the biasing member is about 0.438 inch and the width of the panel engaging tab 16 is about 0.188 inch. With these dimensions, the tool holder 10 is suitable for panel thicknesses ranging from ⅛ inch to ¼ inch. In this regard, the tool holder 10 can accommodate supports panels having such standard size thicknesses as an ⅛, 3/16, 7/32 and ¼ inch. It is noted that the tab 16, having a 0.188 inch width, may require pushing through the 0.188 inch perforation in the ⅛ inch panel, depending on, for example, tolerances in the manufacture of the support panel and tool holder 10. The aperture 30 of the tool holder 10 has a diameter of about 9/32 inch (0.281 inch). A standard ⅛ inch thick support panel typically has 3/16 inch (0.188 inch) diameter perforations, and a standard ¼ inch thick support panel typically has 9/32 inch (0.281 inch) diameter perforations. Thus, the aperture 30 of the tool holder 10 can accommodate either a standard ¼ inch diameter locking screw or a standard ¼ inch diameter locking screw.

Figure 7:
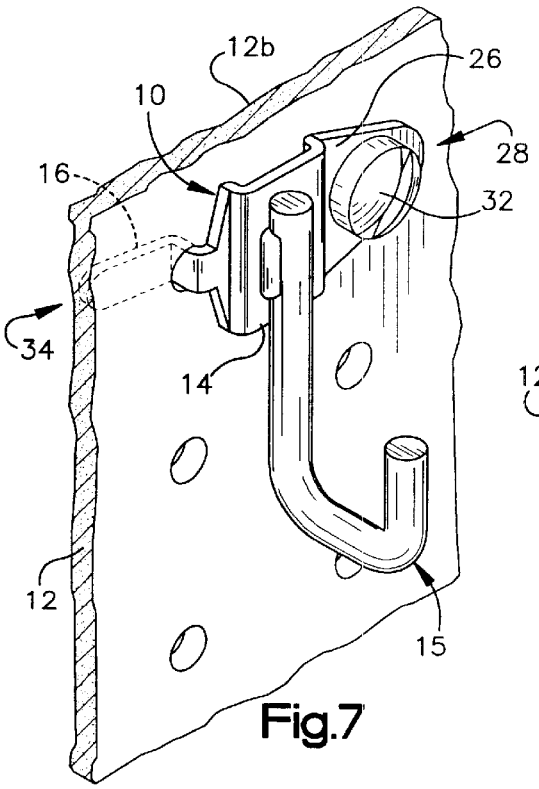
FIG. 7 is a perspective view of a tool holder according to the present invention, the tool holder having a hook welded to a central engagement portion of the tool holder, and being shown installed in a panel in a horizontal manner.
Figure 8:
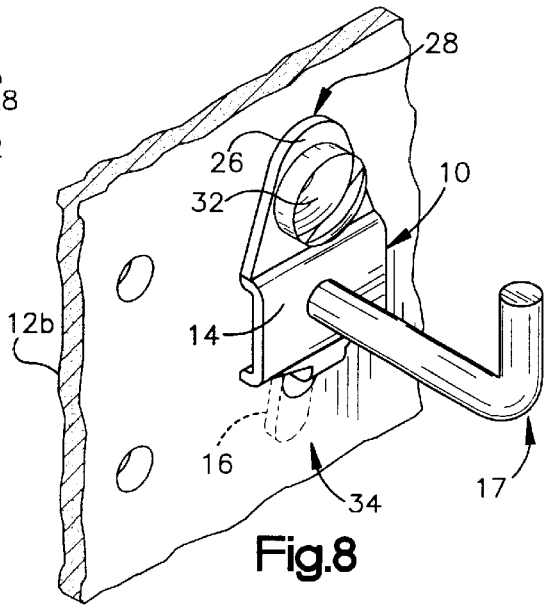
FIG. 8 is a perspective view of a tool holder according to the present invention, the tool holder having a hook welded to a central engagement portion of the tool holder, and being shown installed in a panel in a vertical manner.

Referring now to FIGS. 7 and 8, there is shown two different applications of the tool holder 10 in accordance with the present invention. As is shown in FIG. 7, the tool holder 10 has a hook 15 connected to the engagement portion 14 of the tool holder 10 (for example, by welding if a steel tool holder, or by a molding process if a plastic tool holder). The hook 15 extends from the engagement portion 14 in a direction that is perpendicular to the panel engaging tab 16 and in a plane parallel to a plane of the engagement portion 14 and the base plate 26. When the tool holder 10 is secured to the support panel 12, both ends 28 and 34 of the tool holder 10 (i.e., via fastener 32 and via the panel engaging tab 16) provide support at the rear surface 12*b* of the support panel 12 for the hook 15 extending from the engagement portion 14 therebetween and extending vertically downward adjacent to the support panel 12. (By contrast, a tool holder without the panel engaging tab 16 would not have support behind the support panel at the tab end). It will be appreciated, then, that the panel engaging tab 16 provides improved strength and rigidity of a connection of the tool holder 10 to the support panel 12 in a horizontal (or left-to-right) attachment fashion.

Another advantage of the arrangement of the tool holder 10 and hook 15 shown in FIG. 7 is that the tool holder 10 may be installed into the support panel 12 without the hook 15 interfering with the support panel 12. This is made possible by the hook 15 extending perpendicular to the panel engaging tab 16 and in a plane parallel to the plane of the engagement portion 14 and the base plate 26. The tool holder 10 is installed in a left-to-right horizontal fashion, with the panel engaging tab 16 being inserted into a first perforation 13, and the fastener 32 securing the base plate 26 of the tool holder 10 in a second perforation 13 that is located to the right of the first perforation 13. In so doing, the hook 15 remains spaced apart from the support panel 12. (By contrast, if the hook 15 extended in the same direction as, and parallel to, the panel engaging tab 16, the hook 15 would interfere with the support panel 12 when it is attempted to insert the panel engaging tab 16 into the first perforation 13.) Thus, the tool holder 10 and hook 15 arrangement of FIG. 7 simplifies installation of a hook 15 disposed adjacent (and parallel in the illustrated embodiment) to the plane of the support panel 12.

Referring to FIG. 8, the tool holder 10 has a hook 17 connected to the engagement portion 14 of the tool holder 10. The hook 17 extends from the engagement portion 14 in a direction that is perpendicular to the plane of the engagement portion 14 and the base plate 26. Here, the tool holder 10 is installed in a bottom-to-top vertical fashion, with the panel engaging tab 16 being inserted into a first perforation 13, and the fastener 32 securing the base plate 26 of the tool holder 10 via a second perforation 13 that is located above the first perforation 13. With this arrangement, the tool holder 10 provides support for a hook 17 extending in a perpendicular fashion relative to the support panel 12.

It will be appreciated, then, that the tool holder 10 in accordance with the present invention may be adapted to multiple different applications and embody different arrangements with the hook or other implement to be connected to the tool holder 10. In this regard, the tool holder 10 provides the advantage of being versatile.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A tool holder for attachment to a perforated support panel, the support panel having at least first and second spaced perforations passing therethrough, the tool holder comprising:

a base plate at one end thereof and a panel engaging tab at an opposite end thereof, wherein the base plate includes an aperture for receiving therethrough a fastener for insertion into the first perforation to attach the tool holder to the support panel, and wherein the panel engaging tab is sized and dimensioned for insertion into the second perforation and includes a step portion connected to the base plate and adapted to extend rearwardly from the base plate a distance less than the thickness of the support panel such that, when the tool holder is attached to the support panel by the fastener, a front surface of the tab engages a rear surface of the support panel at a portion of the perimeter of the second perforation, whereby the tab flexes relative to the base plate.

2. A tool holder as set forth in claim 1, wherein the base plate includes an engagement portion located between the aperture and the panel engaging tab for securing thereto a tool supporting implement.

3. A tool holder as set forth in claim 2, wherein the panel engaging tab extends from the base plate such that, when the tool holder is attached to the support panel by the fastener, a tool supporting implement secured to the engagement portion engages the front surface of the support panel.

4. A tool holder as set forth in claim 2, wherein the engagement portion is offset forwardly from a front surface of the base plate.

5. A tool holder as set forth in claim 1, wherein the step portion is spaced from the center of the aperture approximately the same distance as the distance between the first and second perforations.

6. A tool holder as set forth in claim 1, wherein the panel engaging tab extends from the base plate such that, when the tool holder is attached to the support panel by the fastener, a rear surface of the base plate engages a region of the front surface of the support panel.

7. A tool holder as set forth in claim 6, wherein the region at which the rear surface of the base plate engages the front surface of the support panel is at a portion of the perimeter of the second perforation diametrically opposite that at which the front surface of the tab engages the rear surface of the support panel.

8. A tool holder as set forth in claim 1, wherein the panel engaging tab includes a biasing member extending from the step portion that is sloped rearwardly and outwardly relative to a plane in which the rear surface of the base plate lies.

9. A tool holder for installation into a first support panel or a second support panel, the support panels having different thicknesses and respective first and second perforations having different diameters, the tool holder comprising:

a base plate at one end thereof, a biasing member at an opposite end thereof, and an intermediate step portion therebetween, wherein the biasing member is sized and dimensioned for insertion into either of the first or second perforations and the step portion is less in length than the thickness of either the first or second support panels such that, when the biasing member is inserted into either of the first or second perforations and urged towards a rear surface of the respective first or second support panel and the base plate is urged towards a front surface thereof and attached thereto, the biasing member flexes relative to the base plate and secures the tool holder to the respective support panel.

10. A tool holder as set forth in claim 9, wherein a front surface of the biasing member engages the rear surface of the respective first or second support panel at a portion of the perimeter of the respective first or second perforation.

11. A tool holder as set forth in claim 10, wherein a rear surface of the base plate engages a front surface of the respective first or second support panel at a portion of the perimeter of the respective first or second perforation at a region diametrically opposite that of the portion of the perimeter at which the front surface of the biasing member engages the rear surface of the respective first or second support panel.

12. A tool holder as set forth in claim 9, wherein the tool holder includes an aperture sized for receiving either a first fastener or a second fastener having a different diameter than that of the first fastener, wherein the first fastener includes threads which engage the edge of the first perforation to attach the tool holder to the first support panel and wherein the second fastener includes threads which engage the edge of the second perforation to attach the tool holder to the second support panel.

13. A tool holder as set forth in claim 9, wherein the biasing member and base plate extend in opposite directions from the step portion.

14. A tool holder as set forth in claim 9, wherein the biasing member is in a plane that is at a non-parallel angle relative to a plane in which the base plate is in.

15. A tool holder as set forth in claim 14, wherein the angle is about seven degrees rearwardly and outwardly relative to the plane in which the base plate is in.

16. In combination, a tool holder and a tool supporting implement, the tool holder being adapted for installation into a support panel having a front surface and a rear surface and having first and second horizontally spaced apart perforations, wherein the tool holder comprises a base plate at one end thereof, wherein the base plate is adapted to receive a fastener for securing the base plate to the support panel via the second perforation, a biasing member at an opposite end thereof, wherein the biasing member is sized and dimensioned for insertion into the first perforation, and an intermediate step portion therebetween, wherein the tool supporting implement is connected to the base plate in a direction that is perpendicular to the biasing member and in a plane parallel to the plane of the base plate such that, when the tool holder is secured to the support panel, the biasing member of the tool holder provides support at the rear surface of the support panel for the tool supporting implement, and the tool supporting implement extends from the base plate in a vertical direction and parallel relative to the support panel.

17. The combination as set forth in claim 16, further comprising a screw for securing the base plate to the support panel via the second perforation, wherein, when the tool holder is secured to the support panel, the screw provides support at the rear surface of the support panel.

18. A tool holder as set forth in claim 1, further comprising a screw for insertion through the aperture of the base plate, the screw including threads which engage the edge of the first perforation to draw the base plate into adjacent relation with the support panel to secure the tool holder to the support panel.

19. A tool holder as set forth in claim 18, further comprising a support panel having a first perforation passing therethrough which is sized to receive in threading engagement the screw, and a second perforation passing therethrough and spaced from the first perforation which is sized to receive therethrough the panel engaging tab.

20. A method for attaching a tool holder to a support panel, the support panel having at least first and second spaced perforations passing therethrough, the tool holder including a base plate at one end thereof, a biasing member at an opposite end thereof, and an intermediate step portion therebetween, the step portion extending rearwardly from the base plate a distance less than the thickness of the support panel, the biasing member extending from the step portion and being sloped rearwardly and outwardly relative to the rear surface of the base plate, the method comprising:

inserting the biasing member into the second perforation until the distal end of the biasing member extends behind the rear surface of the support panel and the step portion resides inside the second perforation;

tilting the tool holder so that the base plate is moved towards the front surface of the support panel and the biasing member is moved towards the rear surface of the support panel;

urging the base plate against resistance of the base plate at the front surface of the support panel, and against resistance of the biasing member at the perimeter of the second perforation at the rear surface of the support panel, such that the biasing member flexes and the distal end of the biasing member is urged away from the rear surface of the support panel to accommodate the thickness of the support panel; and inserting the fastener to position it relative to the base plate and the first perforation and threading the fastener into the first perforation to draw the base plate into adjacent relation with the support panel, whereby the resistance of the base plate and the resistance of the biasing member create a preload in the fastener.

21. A method as set forth in claim 20, wherein the base plate includes an aperture for receiving therethrough a fastener, and wherein said step of placing the fastener comprises inserting the fastener through the aperture.

* * * * *